US007605681B2

(12) United States Patent
Wobben

(10) Patent No.: US 7,605,681 B2
(45) Date of Patent: Oct. 20, 2009

(54) TRANSFORMER

(76) Inventor: Aloys Wobben, Argestrasse 19, Aurich (DE) 26607

( * ) Notice: Subject to any disclaimer, the term of this patent is extended or adjusted under 35 U.S.C. 154(b) by 137 days.

(21) Appl. No.: 10/502,578

(22) PCT Filed: Jan. 22, 2003

(86) PCT No.: PCT/EP03/00578

§ 371 (c)(1),
(2), (4) Date: Feb. 23, 2005

(87) PCT Pub. No.: WO03/065389

PCT Pub. Date: Aug. 7, 2003

(65) Prior Publication Data

US 2005/0140483 A1 Jun. 30, 2005

(30) Foreign Application Priority Data

Jan. 30, 2002 (DE) ..... 102 03 651

(51) Int. Cl.
*H01F 21/06* (2006.01)

(52) U.S. Cl. ..... 336/130

(58) Field of Classification Search ..... 336/115–119, 336/130–132, 233–234; 310/65, 154.41, 310/156.51–79, 41, 154
See application file for complete search history.

(56) References Cited

U.S. PATENT DOCUMENTS

| | | | | |
|---|---|---|---|---|
| 4,138,783 | A * | 2/1979 | Portier | 29/606 |
| 5,608,771 | A | 3/1997 | Steigerwald et al. | 378/15 |
| 6,388,548 | B1 | 5/2002 | Saito et al. | |
| 2002/0033748 | A1 * | 3/2002 | Bolotinsky et al. | 336/182 |

FOREIGN PATENT DOCUMENTS

| | | | |
|---|---|---|---|
| DE | 37 44 122 | A1 | 7/1989 |
| DE | 196 49 682 | A1 | 6/1998 |
| DE | 100 20 949 | A1 | 2/2001 |
| DE | 100 12 981 | A1 | 9/2001 |
| DE | 199 53 583 | C1 | 12/2001 |
| EP | 0 688 028 | A1 | 12/1995 |
| JP | 53-161220 | | 12/1978 |
| JP | 58-089083 | A | 5/1983 |
| JP | 05-304752 | A | 11/1993 |
| JP | 07-042117 | U | 7/1995 |
| JP | 2000-150273 | A | 5/2000 |
| WO | 01/25628 | A2 | 4/2001 |

* cited by examiner

*Primary Examiner*—Tuyen T. Nguyen
(74) *Attorney, Agent, or Firm*—Seed IP Law Group PLLC

(57) ABSTRACT

A transformer for transferring electrical power from a stationary member to a rotating member, with a primary winding and a secondary winding, by means of annular primary and secondary windings disposed in annular slots. The transformer of the kind initially specified can be designed with smaller dimensions and can transfer more power with the same dimensions.

15 Claims, 5 Drawing Sheets

Fig. 1
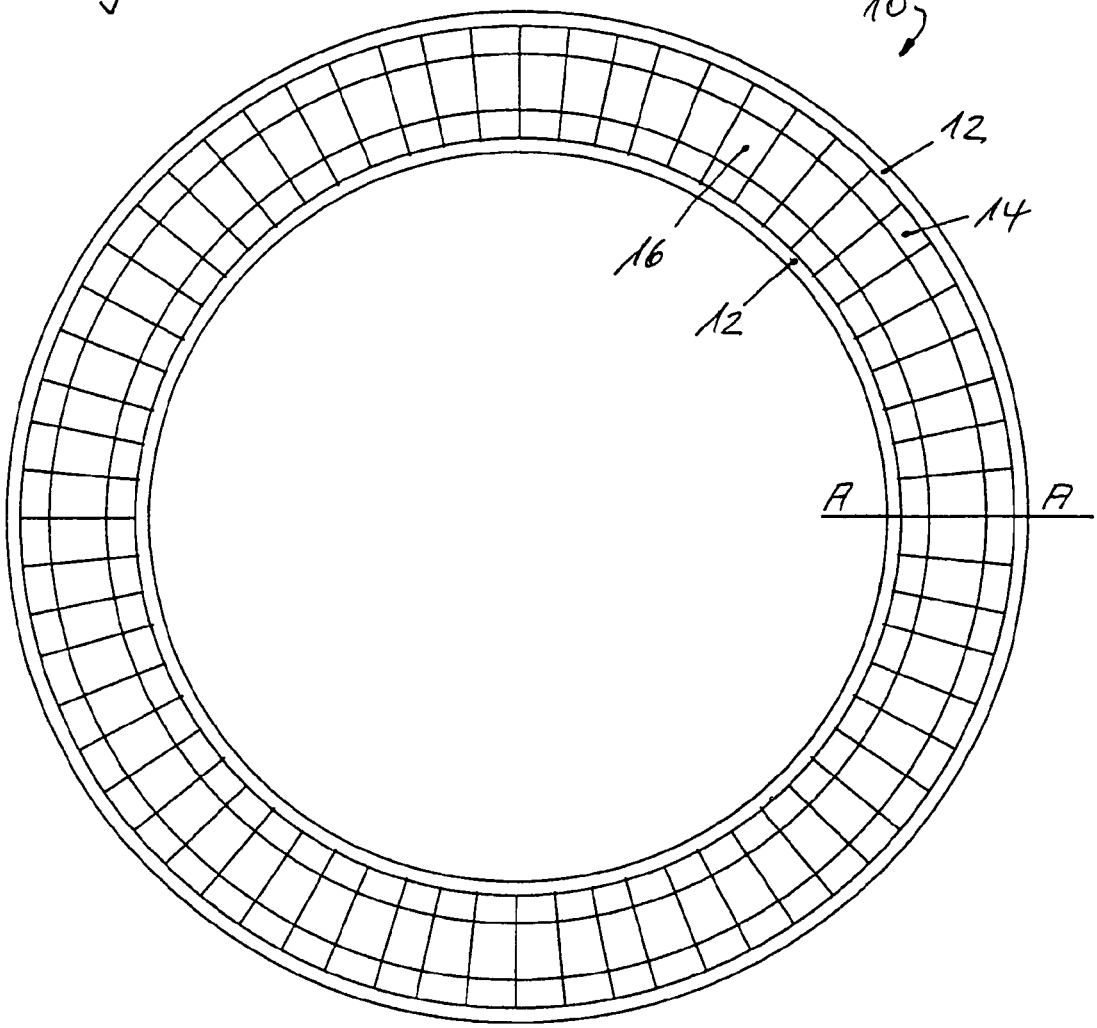
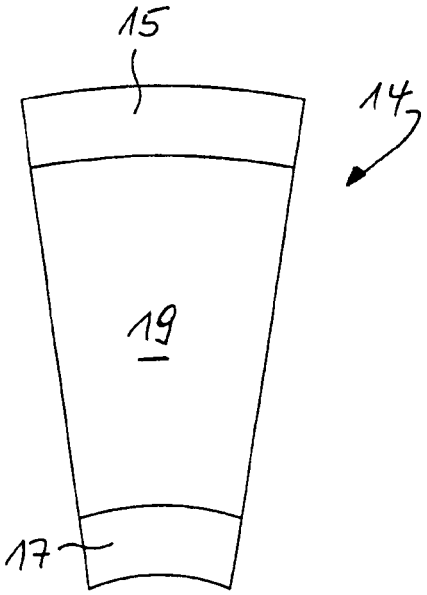
Fig. 2
Fig. 3
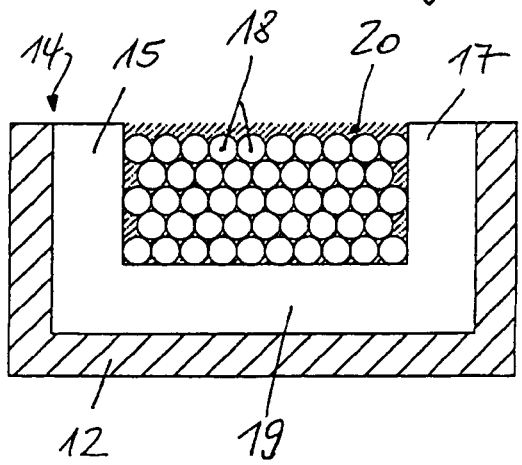

TRANSFORMER

BACKGROUND OF THE INVENTION

1. Field of the Invention

The present invention relates to a transformer for transferring electrical power from a stationary member to a rotating member, and comprising a primary winding and a secondary winding.

2. Description of the Related Art

Such transformers are known as asynchronous machines, in which the stator winding forms the primary winding and the rotor winding forms the secondary winding, or vice versa. The dissipation heat produced during power transfer as a result of hysteresis losses is so considerable that, on the one hand, the transferable power is limited to a few kilowatts. On the other hand, said heat must be dissipated and therefore necessitates a certain minimum size of transformer with a sufficiently large surface.

An alternating-current transformer for brushless transfer, without slip-rings, of slip power from the rotor of an asynchronous machines to a stationary machine component is known from DE 199 53 583 C1. Said transformer comprises a stationary primary part and a rotating secondary part mounted on the shaft of the asynchronous machine. Each of said parts carries an alternating-current winding with tangentially wound coils.

An electric motor and a method for making a laminated core of a stator of an electric motor is known from DE 198 42 948 A1.

A non-contact type transformer in which each disk-shaped magnetic core is formed by a combination of several fan-shaped cores is known from DE 100 20 949 A1. Said magnetic cores each have at least one concentric and one radial slot for receiving the windings.

An electromagnetic coupler for transferring energy is known from EP 0 688 028 A1. In both the primary stage and the secondary stage, the core is annularly arranged and has annular grooves in which ring-shaped coils are set. The core arrangement comprises at least one package with laminated transformer elements.

A transformer for a computer tomography (CT) system is known from U.S. Pat. No. 5,608,771. Both the stator core and the rotor core are integral in construction and have at least one annular slot for receiving the windings.

A magnetic material for power transmission cores with low permeability and low power loss, in the form of a homogenous composition of ferrite and plastic, is known from DE 42 14 376 A1.

BRIEF SUMMARY OF THE INVENTION

One object of the present invention is therefore to provide a transformer in which the dissipation heat is reduced, and which can therefore have smaller dimensions, or, with the same dimensions, can transfer a greater amount of power.

This object is achieved with a transformer pursuant to claim 1.

The invention is based on the realization that, in known rotary machines such as asynchronous machines, structural depth is a factor that contributes substantially to the heat dissipation problem. Conversely, this means that a substantial part of the heat dissipation problem can be solved with a construction that is as thin as possible.

According to the invention, the transformer has a rotating body comprised of members in the shape of ring segments, wherein said rotating body has slots that are open in the axial or radial direction, and the material of said members is ferrite. In this way, it is possible to create a rotating body with favorable magnetic properties and without air gaps, and which allows power to be transferred with a particularly low amount of loss.

In order to keep forces acting on the transformer away from the rotating body and hence to prevent deformation of or damage to the latter, a support structure for receiving the members is provided.

In a wind turbine fitted with a transformer according to the invention, the excitation power can be transferred, for example, from the stationary member of the wind turbine to the rotating member, such as the rotor of the generator. Of course, it is also possible to use a plurality of adjacent transformers for multiphase transmission.

A frequency of up to 300 kHz, preferably of about 20 kHz, has proven advantageous for operating a transformer according to the invention such that the effect of inductance and the loss of energy are minimized.

BRIEF DESCRIPTION OF THE DRAWINGS

Advantageous developments of the invention are described in the subclaims. The invention shall now be described in detail with reference to the drawings, which show:

FIG. 1 shows a side view of a first embodiment of a rotating body;

FIG. 2 shows a single segment of the rotating body in FIG. 1;

FIG. 3 shows a cross-sectional view along line A-A in FIG. 1;

DETAILED DESCRIPTION OF THE INVENTION

Figure 4:
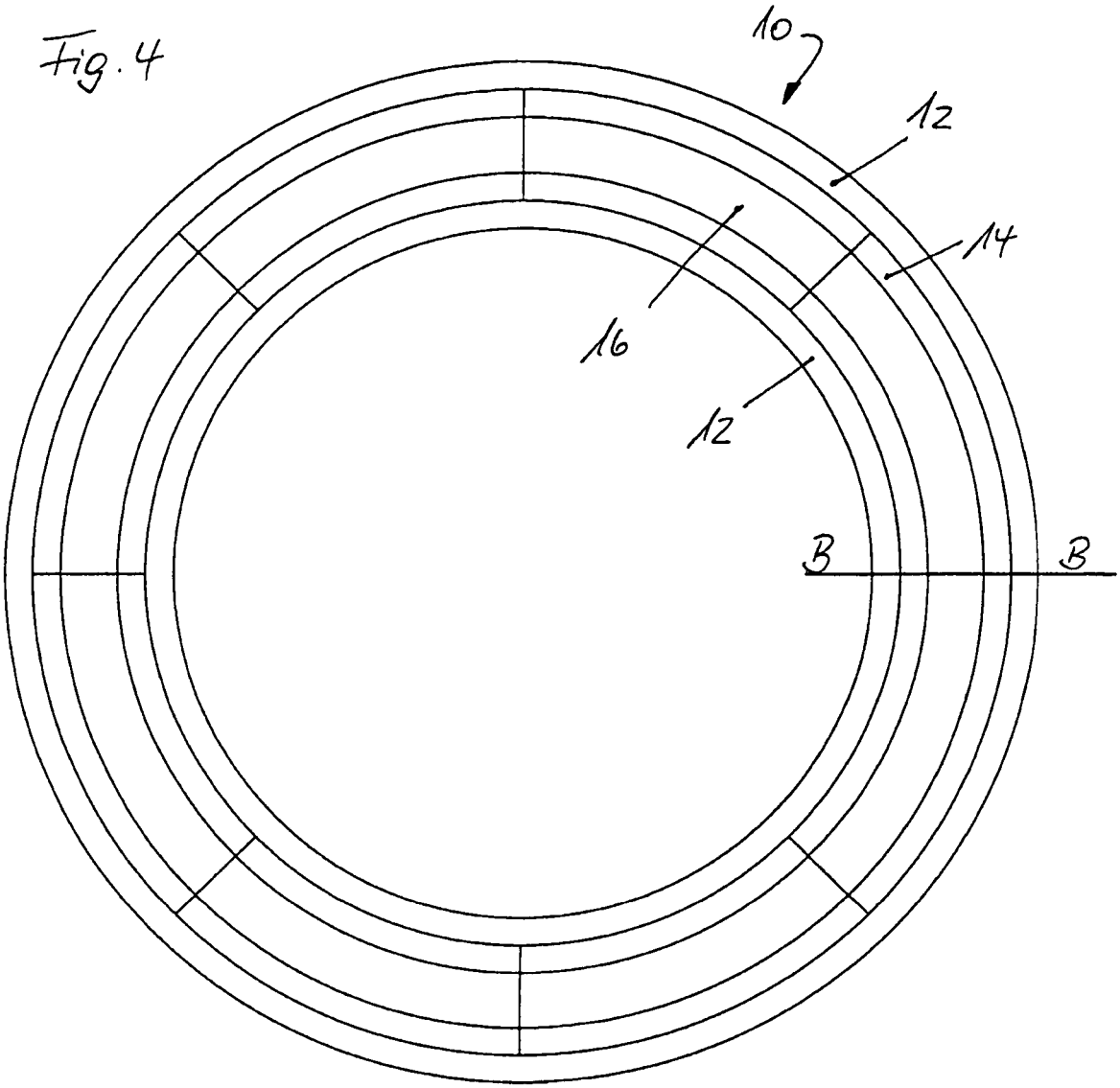
FIG. 4 shows a side view of a second embodiment of the rotating body.

FIG. 1 shows a ring of a transformer 10 according to the invention. Said ring has a support structure 12 into which members 14 are inserted. Said members 14 fill completely the inner space formed by the support structure 12, with the result that there is no air gap between the separate members 14. A slot 16 is defined in each of the members 14. The annular arrangement of the members 14 results in an annular slot 16 into which a winding can be placed.

FIG. 2 shows a single member 14 in plan view. In said view, the ring segment shape of the member can be clearly seen. Segment 14 has an upper bar 15, a lower bar 17 and a cross-piece 19 therebetween. Bars 15, 17 run substantially perpendicular to the cross-piece 19, such that a U-shaped cross-section results, wherein bars 15, 17 and the cross-piece 19 define the slot therebetween.

Said U-shaped cross-section can be seen well in FIG. 3, which is a cross-sectional view along line A-A in FIG. 1. The support structure 12 into which the member 14 is inserted is also included in said Figure, and is likewise shown here with a U-shaped cross-section. It can also be seen from said Figure that the member 14 comprising bars 15, 17 and cross-piece 19 is of integral construction. A winding 18 is placed into the slot, and the remaining space inside the slot is filled with a filling compound 20. Said filling compound serves, on the one hand, to fixate the winding in the slot and, on the other hand, provides corrosion protection by preventing any penetration of moisture into the slot.

FIG. 4 shows an alternative embodiment of a transformer ring 10 according to the invention. Here, too, members 14 are shown inside the support structure 12. Said members 14 are similar to those shown in FIG. 1 and likewise form ring segments. Likewise, there is an annular slot 16 into which a winding can be placed. In addition to the fact that each of the members 14 shown in the form of ring segments in FIG. 4 extends across a larger radian measure than shown in FIG. 1, another difference consists in the different structure of the members 14. This difference can be clearly seen in FIG. 5.

Figure 5:
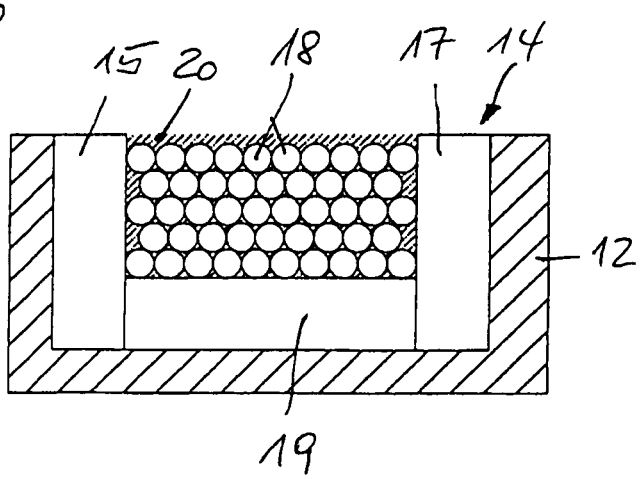
FIG. 5 shows a cross-sectional view of the second embodiment of the rotating body, along line B-B in FIG. 4.

FIG. 5 shows a cross-section along line B-B in FIG. 4. It can be seen from FIG. 5 that a U-shaped support structure 12, into which the member 14 is received, is likewise provided. Said member 14 also has a U-shaped cross-section, but the upper bar 15, the lower bar 17 and the cross-piece 19 are configured as separate parts that are joined together to form a U-shape. This embodiment simplifies production of the bars 15, 17 and the cross-piece 19. Between said bars 15, 17 and the cross-piece 19, a slot is likewise formed within which a winding 18 is accommodated, said slot being filled with a filling compound 20.

Figure 6:
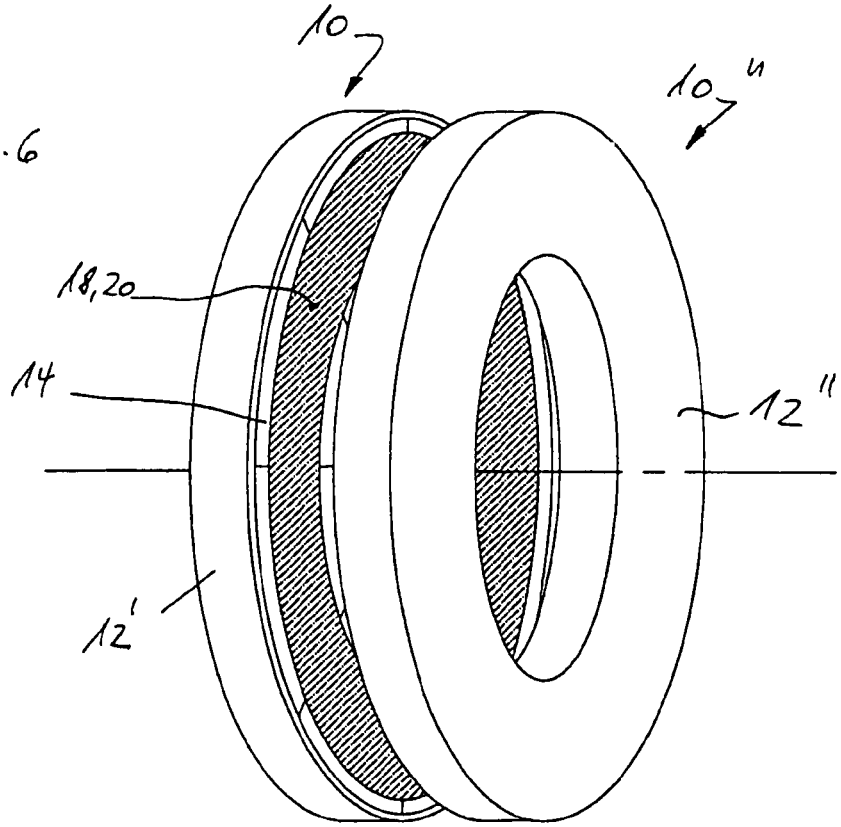
FIG. 6 shows a perspective view of the arrangement of two rotating bodies.

FIG. 6 shows two transformer rings 10 axially opposite each other. However, it must be noted here that the gap between said transformer rings 10 in this Figure is shown with this size for illustration purposes only, and in normal operation is kept as small as possible. In this Figure, support structures 12' and 12" can again be seen, within which members 14 form the magnetic ring inside which the winding 18 and the filling compound 20 are installed in a slot. One of these two transformer rings 10 is connected to a stationary portion of a device, for example the generator stator of a wind turbine, whereas the other transformer ring 10 is connected to a rotating portion, for example the rotor of a ring generator. The axis of rotation is shown by a dot-dash line. Since both transformer rings 10 are exactly opposite each other, energy can be transferred from the primary winding via the magnetic circuit to the secondary winding, as in a transformer.

Figure 7:
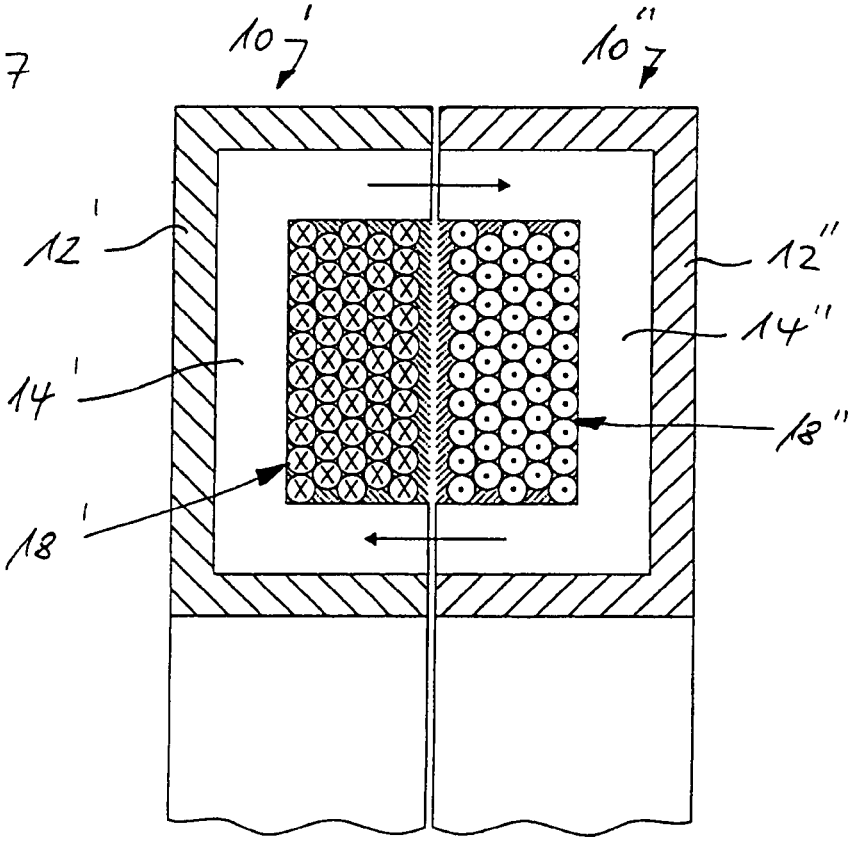
FIG. 7 shows a partial cross-section of the rotating bodies.

This is further elucidated in FIG. 7. Said Figure shows a cross-sectional view through the upper portion of two opposite transformer rings 10. Both transformer rings 10', 10" have a support structure 12', 12", inside which the magnetic circuit is formed by members 14' 14", shown here as integral elements. It is important here that the gap between the opposite members, and hence the air gap in the magnetic circuit, is as small as possible, for example 0.1 mm-10 mm. Windings 18', 18" are disposed in each of the slots defined by members 14', 14". Winding 18' shown on the left in said Figure is the primary winding, and winding 18" shown on the right is the secondary winding. In the primary winding, the direction of current flow is shown pointing away from the viewer. This causes a magnetic field, with orientation as shown by the arrows, in the magnetic circuit formed by members 14', 14". Said magnetic field induces a voltage in the secondary winding 18", said voltage producing a flow of current towards the viewer in direction o. In this way, electrical power is transferred by this transformer from the primary (left) side to the secondary (right) side.

Figure 8:
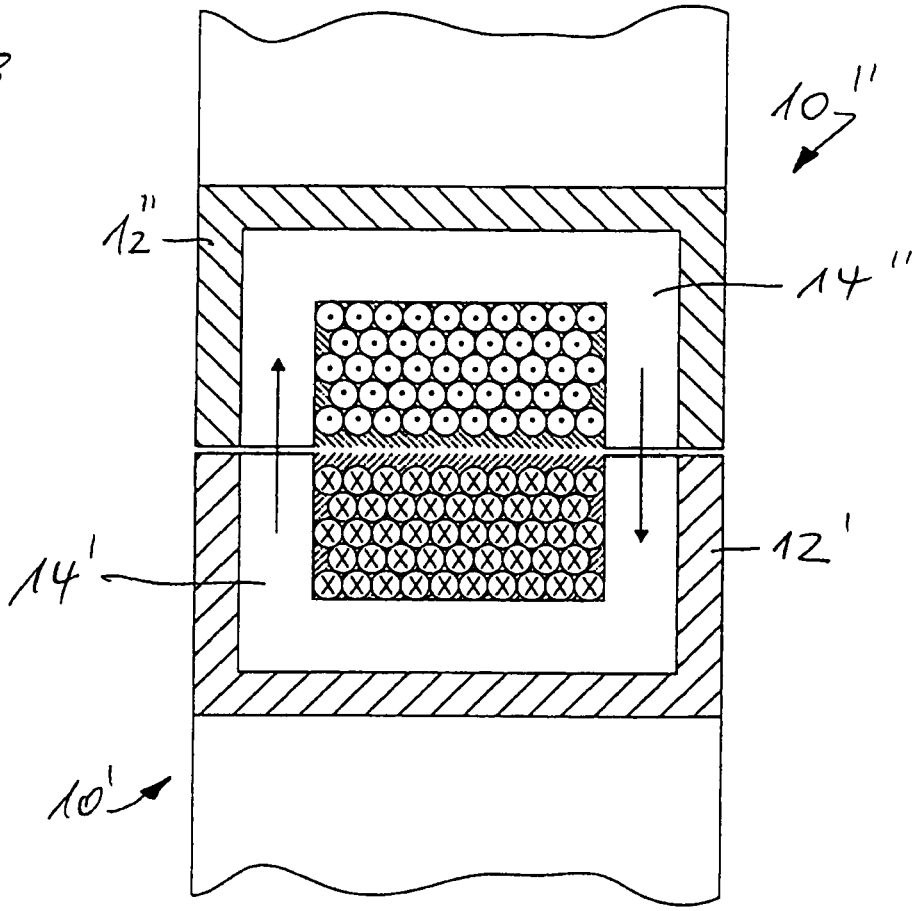
FIG. 8 shows a partial cross-section of an alternative arrangement of the rotating bodies.

FIG. 8 likewise shows two transformer rings 10. However, these are arranged so that they face each other in a radial direction. Here, too, support structures 12', 12" are provided that support integral members 14', 14" that in turn form the magnetic circuit. In said FIG. 8, the lower winding is the primary winding and the upper winding is the secondary winding. The direction of current flow in the primary winding is again away from the viewer. A magnetic field is thus generated in the magnetic circuit, with orientation as indicated by the arrows, said field inducing a voltage in the secondary winding that causes a flow of current in the direction of the viewer. In this radial arrangement as well, the gaps between the members 14' 14" of the magnetic circuit, and hence the air gap in the magnetic circuit, must be as small as possible, for example 1 m-3 mm.

Figure 9:
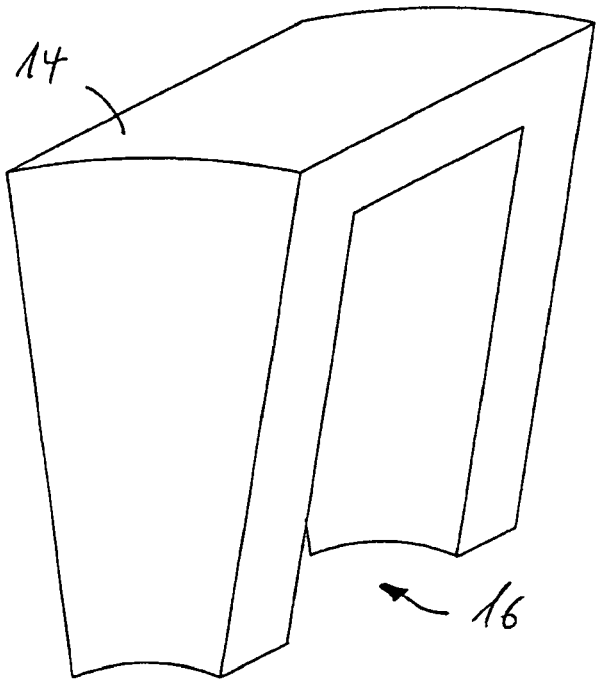
FIG. 9 shows a perspective view of a member for one of the rotating bodies in FIG. 8.

FIG. 9 shows a member 14 in a simplified perspective view. It is evident from the shape of said member 14 that a plurality of such members arranged in sequence will result in a ring with a slot 16 that is downwardly open. Accordingly, members 14 with this shape are installed in the upper support structure 12 in FIG. 8 and form a ring with a downwardly open slot 16.

Figure 10:
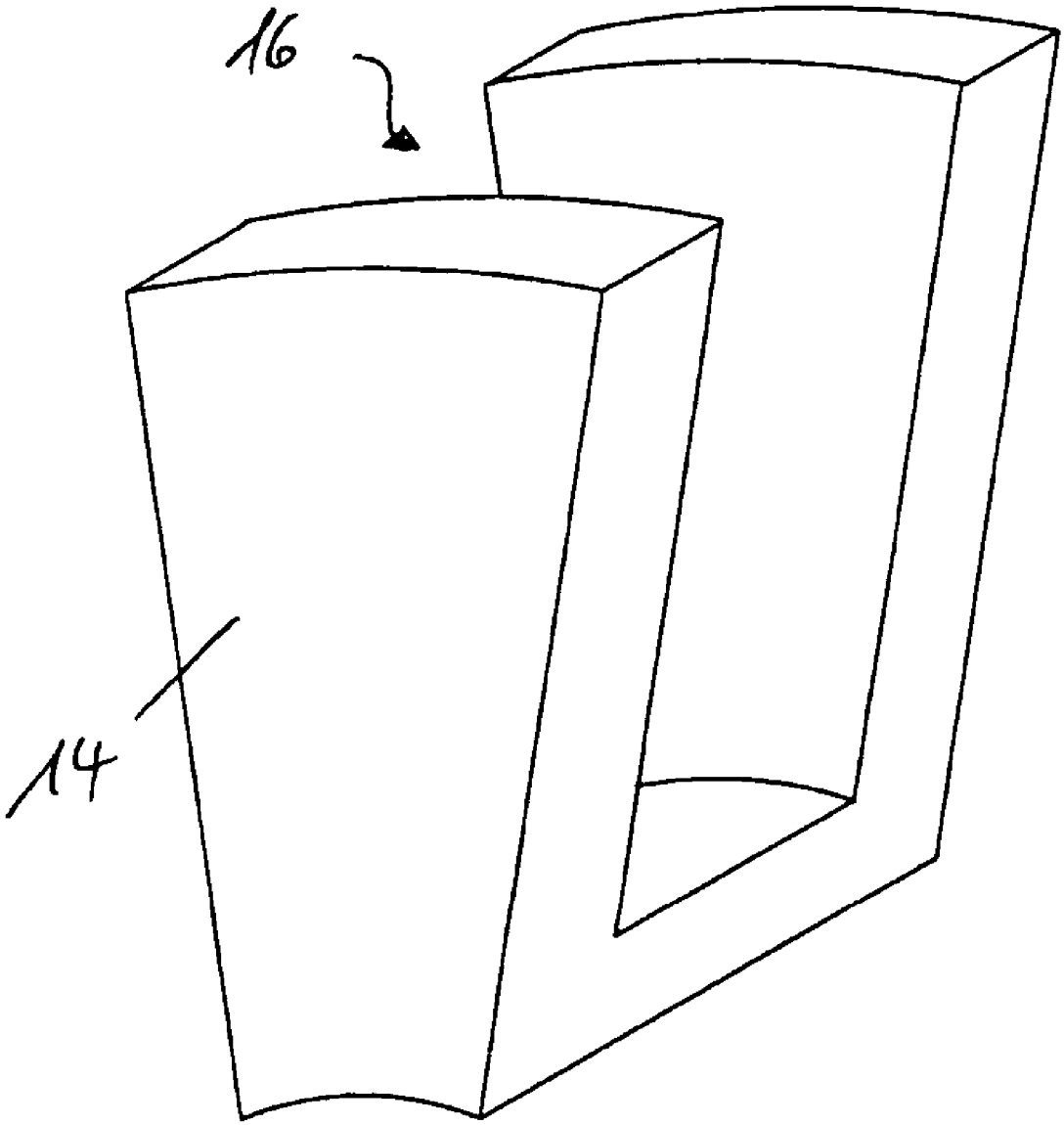
FIG. 10 shows a perspective view of a member for the other rotating body shown in FIG. 8.

FIG. 10 likewise shows a simplified perspective view of a member 14. Said member 14 is fitted into the lower support structure 12 in FIG. 8, thus forming a ring with an upwardly open slot.

By using the members shown in FIGS. 9 and 10, it is possible to manufacture a transformer pursuant to the invention with rings radially opposite each other.

The intended use of the transformer according to the invention, for example in operating a generator, e.g., a synchronous machine, is to feed the electrical control power to the rotor of the generator. Said control power may be in a range in excess of 50 kW, for example, and preferably in a range between about 80 kW and 120 kW.

The particular advantage of the transformer according to the invention is that the slip-ring rotor used hitherto for applying electrical excitation power to the rotor of the generator is no longer necessary, thus avoiding what was previously a source of wear and tear in the wind turbine. Since the electrical excitation power is transferred wirelessly using the transformer according to the invention, no such wear and tear occurs.

An electrical transformer according to the invention can be used, in particular, in synchronous generators/ring generators. Such generators have a relatively large diameter at power ratings greater than 500 kW, e.g., more than 4 m, and therefore provide sufficient space to accommodate the transformer according to the invention.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A synchronous generator of a wind turbine being coupled to a transformer to transfer electrical power from a stationary member to a rotating member, the transformer comprising:

an annular core form to receive an annular winding and having annular slots open in an axial or radial direction;

an annular primary winding and an annular secondary winding disposed in the annular slots, the primary and secondary windings arranged axially or radially opposite each other, the primary winding disposed on the stationary member and the secondary winding disposed on the rotating member; and a plurality of members each having a U-shaped cross-sectional configuration that includes a first bar portion, a second bar portion and a crosspiece portion between the first and second bar portions and of an integral construction, each of the plurality of members having a shape of a ring segment such that each of the plurality of members is in an angular form of an arc of a ring and are a part of the annular core form, wherein the transformer is configured to transfer to a rotating portion of the generator the excitation power for operating the generator, the excitation power being more than 50 kW.

2. The transformer of claim 1, further comprising a support structure to receive the stationary and rotating members.

3. The transformer of claim 1, wherein a material of the stationary and rotating members is ferrite.

4. The transformer of claim 1, wherein the stationary and rotating members are formed of toroidal tape cores.

5. A wind turbine, comprising:

a transformer having:

an annular core form to receive an annular winding and having annular slots open in an axial or radial direction, an annular primary winding and an annular secondary winding disposed in the annular slots, the primary and secondary windings arranged axially or radially opposite each other, the primary winding disposed on a stationary member and the secondary winding disposed on a rotating member, and a plurality of members each having a U-shaped cross-sectional configuration that includes a first bar portion, a second bar portion and a crosspiece portion between the first and second bar portions and of an integral construction, each of the plurality of members having a shape of a ring segment with a length of the first bar portion being shorter than a length of the second bar portion such that each of the plurality of members is in an angular form of an arc of a ring or each of the plurality of members having an annular slot open in a radial direction and the first and second bar portions being of a same length such that each of the plurality of members is in the angular form of the arc of the ring and are a part of the annular core form; and a generator having a stator coupled to the primary winding disposed on the stationary member and a rotor coupled to the secondary winding disposed on the rotating member.

6. The wind turbine of claim 5, wherein the generator is a synchronous generator operable to receive from the transformer excitation power to operate the synchronous generator.

7. The wind turbine of claim 5, wherein the transformer operates at an operation frequency of up to 300 kHz.

8. The wind turbine of claim 5 wherein the transformer operates at an operation frequency of approximately 20 kHz.

9. The wind turbine of claim 5 wherein the transformer is operable to transfer to the rotor of the generator excitation power to operate the generator.

10. The transformer of claim 2, wherein the support structure comprises:

a support member that is an annular ring having a U-shaped cross-section, the support member being shaped to receive the plurality of members in an internal channel and to have an outer wall, inner wall and a bottom to support and enclose the plurality of members.

11. The wind turbine of claim 9 wherein the transformer is operable to transfer to the rotor of the generator excitation power greater than 50 kW.

12. The wind turbine of claim 9 wherein the transformer is operable to transfer to the rotor of the generator excitation power between 80 kW and 120 kW.

13. A transformer to transfer electrical power from a stationary member to a rotating member, the transformer comprising:

a rotatable annular core defining an open annular slot and having a plurality of members, each member of the plurality of members of the rotatable annular core having an open U-shaped cross-sectional configuration that forms a portion of the annular slot and that includes a first bar portion, a second bar portion and a crosspiece portion between the first and second bar portions, each member of the plurality of members of the rotatable annular core having a shape of a ring segment such that each of the plurality of members of the rotatable annular core is in an angular form of an arc of a ring;

a stationary annular core defining an open annular slot and having a plurality of members, each member of the plurality of members of the stationary annular core having an open U-shaped cross-sectional configuration that forms a portion of the annular slot and that includes a first bar portion, a second bar portion and a crosspiece portion between the first and second bar portions, each member of the plurality of members of the stationary annular core having a shape of a ring segment such that each of the plurality of members of the stationary annular core is in an angular form of an arc of a ring;

a primary winding disposed in the annular slot of the stationary annular core; and a secondary winding arranged opposite the primary winding and disposed in the annular slot of the rotatable annular core, wherein the rotatable and the stationary annular cores and the primary and the secondary windings are sized and shaped to transfer excitation power in the range of 50 kW to 120 kW to a rotor of a generator.

14. The transformer of claim 13, comprising:

a first support structure configured to receive the rotatable annular core; and a second support structure configured to receive the fixed annular core.

15. The transformer of claim 13 wherein the rotatable and fixed annular cores are separated by a gap in the range of one-hundred micrometers (0.1 mm) to ten millimeters (10 mm).

* * * * *